252-105 AU 157 EX
9/9/86 XR 4,610,728

United States Patent [19]
Natesh et al.

[11] Patent Number: 4,610,728
[45] Date of Patent: Sep. 9, 1986

[54] METHOD AND COMPOSITION FOR DISSOLVING DEPOSITS OF MAGNETITE

[76] Inventors: Ram Natesh, 790 E. 700 South, Centerville, Utah 84105; Mario A. Sellani, 956½ Garfield Ave., Salt Lake City, Utah 84014

[21] Appl. No.: 681,609

[22] Filed: Dec. 14, 1984

Related U.S. Application Data

[63] Continuation-in-part of Ser. No. 435,264, Oct. 19, 1982, abandoned, which is a continuation-in-part of Ser. No. 267,383, May 26, 1981, abandoned.

[51] Int. Cl.[4] ..... C23G 1/19; C23G 1/24
[52] U.S. Cl. ..... 134/2; 134/3; 134/22.16; 134/22.17; 134/22.19; 134/26; 134/28; 134/29; 252/105; 252/135; 252/156; 252/527
[58] Field of Search ..... 134/3, 22.16, 22.17, 134/22.19, 26, 28, 29, 2; 252/105, 135, 527, 156

[56] References Cited

U.S. PATENT DOCUMENTS

| | | | |
|---|---|---|---|
| 2,257,186 | 9/1941 | Orthner et al. | 252/105 |
| 2,488,832 | 11/1949 | Rossi | 252/105 |
| 2,802,788 | 8/1957 | Flaxman | 252/105 |
| 2,935,428 | 5/1960 | Huff | 252/105 X |
| 3,081,265 | 3/1963 | Burr | 252/105 |
| 3,207,694 | 9/1965 | Gogek | 252/105 |
| 4,082,683 | 4/1978 | Galesloot | 252/105 |

*Primary Examiner*—Marc L. Caroff
*Attorney, Agent, or Firm*—Richard F. Bojanowski

[57] ABSTRACT

A process for dissolving deposits of metal oxides, and preferably iron oxides including magnetite without materially impairing the surface on which the deposits reside, which comprises contacting the solid metal oxide with a liquid medium composition comprising (1) an alkali metal borohydride, (2) a chelating agent which forms a metal complex with the metal oxide, said chelating agent being preferably a dialkali metal salt of a polyalkylene polyamine tetraalkanoic acid. The process is particularly effective for the dissolution of $Fe_3O_4$ (magnetite) entrapped in the tube-to-tube sheet crevices of nuclear steam generators.

9 Claims, 2 Drawing Figures

METHOD AND COMPOSITION FOR DISSOLVING DEPOSITS OF MAGNETITE

PRIOR PATENT APPLICATIONS

This patent application is, pursuant to 35 U.S.C. 120 and CFR 1.62, a continuation-in-part of U.S. patent application Ser. No. 06/435,264, filed on Oct. 19, 1982, now abandoned, which in turn was a continuation-in-part of U.S. patent application Ser. No. 06/267,383, filed on May 26, 1981, now abandoned. The inventors are the same in this and the above two patent applications.

FIELD OF THE INVENTION

This invention relates to a new product and process for dissolving deposits of metal oxides, and preferably iron oxides. More particularly, the invention relates to a new and improved composition process for dissolving and removing metal oxide deposits, including magnetite, without materially impairing the surface on which the deposits reside.

Specifically, the invention provides a new and highly efficient process for dissolving metal oxide and magnetite deposits without materially impairing the adjacent metallic surfaces in contact therewith. The method comprises contacting the solid magnetite and/or metal oxides with a liquid medium containing a composition comprising (1) an alkali metal borohydride, (2) a chelating agent which forms a complex with the metal contained in the metal oxide, said chelating agent being preferably a dialkali metal salt of a polyalkyleneamine tetraalkanoic acid, at a neutral to alkaline pH.

The new process of the invention is particularly effective for the dissolution of deposits of magnetite ($Fe_3O_4$) entrapped in the tube-to-tube sheet crevices of nuclear steam generators.

The invention further provides new compositions which may be used in the above-noted process to effect the desired dissolution.

DISCUSSION OF THE PRIOR ART

Numerous large nuclear steam generators have been built here in the United States and in many foreign countries. Each of these generators, which generally cost over one hundred million dollars each, normally contain more than 4000 inconel tubes of about $\frac{7}{8}$ inch in diameter which are mechanically rolled to a carbon steel tube sheet. In the construction of the steam generators, a crevice about 18 inches deep and 0.008 inches wide around each of the tubes is present as the tubes pass through the tube sheet.

Unfortunately, during operation of the nuclear steam generators, the above-noted crevices accumulate deposits of metal oxides, alkali, and salts, and particularly iron oxides including magnetite. The deposits are generally the result of two processes, (1) the concentration and precipitation of impurities or additives in the feed water (water hardness chemicals such as Ca, Mg, Na, K, etc.), and (2) corrosion products grown in the crevices, such as iron oxides and particularly magnetite. With time, and in the hydrothermal environment which includes thermal cycling as a power plant changes load, the metal oxide and salt deposits grow in the crevices and, because of the decreased density, expand against the tubes and eventually cause them to crack and leak. The leakage of radioactive primary water into the secondary system causes a safety hazard. Because of the close spacing of the tubes, mechanical access to individual tubes is very difficult and the cheapest solution has been to stop the flow of water through the tubes using a plug. This, of course, reduces the efficiency of the generator and after many such leaks the generator itself must be shut down.

Attempts have been made in the past to remove the deposits by treatment with acids, such as oxalic acid, and by application of mechanical impact or vibrations, etc., but in all cases either the deposits were unaffected or the treatment seriously affected the functioning or the integrity of the metallic tubes or tube sheet.

There is thus a need in industry for a process for dissolving, removing, or breaking up metal oxides, salt deposits and magnetite in the crevices around the tubes before they cause irreversible damage to the steel or inconel tubes. Such a process should be one that could be operated without stopping the operation of the generators and would not impact the functioning or integrity of the tube sheeting or the tubes themselves.

The break up and dissolution of metal oxides, such as ferric oxide, i.e., rust have been reported in numerous publications. However none of these publications discuss or suggest the treatment and removal of magnetite.

For example, the following U.S. patents disclose that various combinations and concentrations of ingredients can be used to dissolve and remove rust or ferric oxide: U.S. Pat. Nos. 3,081,265; 2,488,832; 2,257,186; 4,082,683; 2,802,788; 3,207,694; and 2,935,428.

Although all of the above patents disclose the use of phosphates, sulfites, EDTA, borohydrides and the like, in various concentrations and combinations, none suggest that particular concentrations of specific combinations are capable of removing and dissolving magnetite or other oxides at their higher state of oxidation.

It is an object of the invention, therefore, to provide a new and improved process for dissolving, removing, or breaking up highly oxidized metal oxide deposits: It is a further object to provide a new process for dissolving metal oxide deposits, which does not materially impair the surface on which the deposits reside and/or the inconel tubes. It is a further object to provide a process for dissolving magnetite deposits which is efficient and economical and easily operated. It is a further object to provide a new process for dissolving and removing magnetite deposits in the crevices of tubing in the nuclear steam generator which can be conducted while the generators are still in operation and which does not materially affect the functioning or integrity of the steel or inconel tubes or tube sheeting. It is a further object to provide a process for dissolving magnetite deposits at a neutral to alkaline pH and at reaction temperatures and pressures above ambient.

SUMMARY OF THE INVENTION

It has now been discovered that these and other objects can be accomplished by the new process of the present invention which comprises contacting the highly oxidized metal oxide deposits contained on the surface to be cleaned with a liquid medium containing a special combination of (1) an alkali metal borohydride, (2) a chelating agent which forms a complex with the metal of the metal oxide, said chelating agent being preferably a dialkali metal salt of a polyalkylene-polyamine tetraalkanoic acid, and then removing the treating solution containing the products of reaction from the surface being cleaned. The process is particularly effective when used at the neutral to alkaline pH range and at reaction temperatures and pressures above ambient.

It has been found that by the use of the above process, deposits of metal oxides and particularly magnetite can be quickly and easily dissolved from a metal surface. The solution containing the byproducts can then be easily removed. A further advantage is realized in that the process surprisingly shows no noticeable impairment of the steel and inconel surfaces containing the deposits. A further advantage is realized in that the process is economical and efficient to operate and may be conducted without closing down the operation of the equipment.

These and other advantages make the process of the invention particularly suited for use in the dissolution, removing or breaking up of metal oxides, salt deposits and magnetite entrapped in the tube-to-tube sheet crevices of a nuclear steam generator. The liquid medium containing the above-noted special ingredients can be easily pumped or passed through the tube areas and in a short while the deposits can be dissolved and the material flushed out with the treating solution. Further, the treatment does not impair the special steel or inconel tubing or otherwise affect the operation of the nuclear steam generators.

While the exact mechanism of the reaction has not been clearly established, it is proposed that the alkali metal borohydride reacts with magnetite to release iron atoms and the chelating agent then reacts with the iron atoms to remove them from the deposits, allowing the alkali metal borohydride to remove further amounts of iron from the deposits and the reaction continues in this manner until the deposits have been dissolved.

The above-noted use of a combination of materials was quite surprising in that the application of only an alkali metal borohydride did not noticeably effect the dissolution of magnetite. It was further found that the application of only a chelating agent, although causing dissolution, also seriously affected the adjacent metal surface. In addition, the use of many other types of reducing agents and chelating agents alone or in combination failed to show noticeable dissolution of the magnetite deposits or in so doing caused serious impairment of the treated surfaces.

In addition to the removal and dissolution of magnetite, scales and reduced oxides of iron, other metals can be removed and dissolved by the process and products of this invention. Thus, all products of corrosion found in crevices of nuclear reactors can be removed including deposits of magnetite which is the most prevalent and the most difficult to remove of all of the iron oxides formed during the corrosion process. The new process of the invention thus truly gives unexpected synergistic results not evident from the prior art.

DETAILED DESCRIPTION OF THE INVENTION

Figure 1:
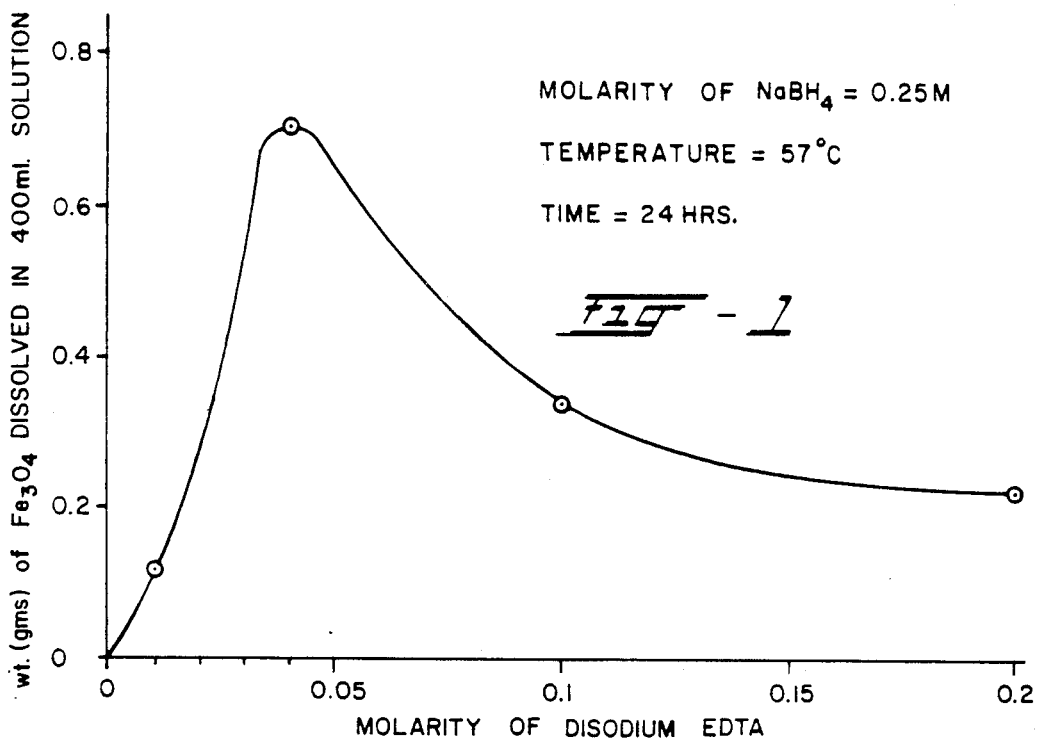
FIG. 1 is a graph illustrating the results obtained when the concentration of sodium borohydride is held constant and the concentration of disodium salt of ethylenediaminetetraacetic acid is varied.
Figure 2:
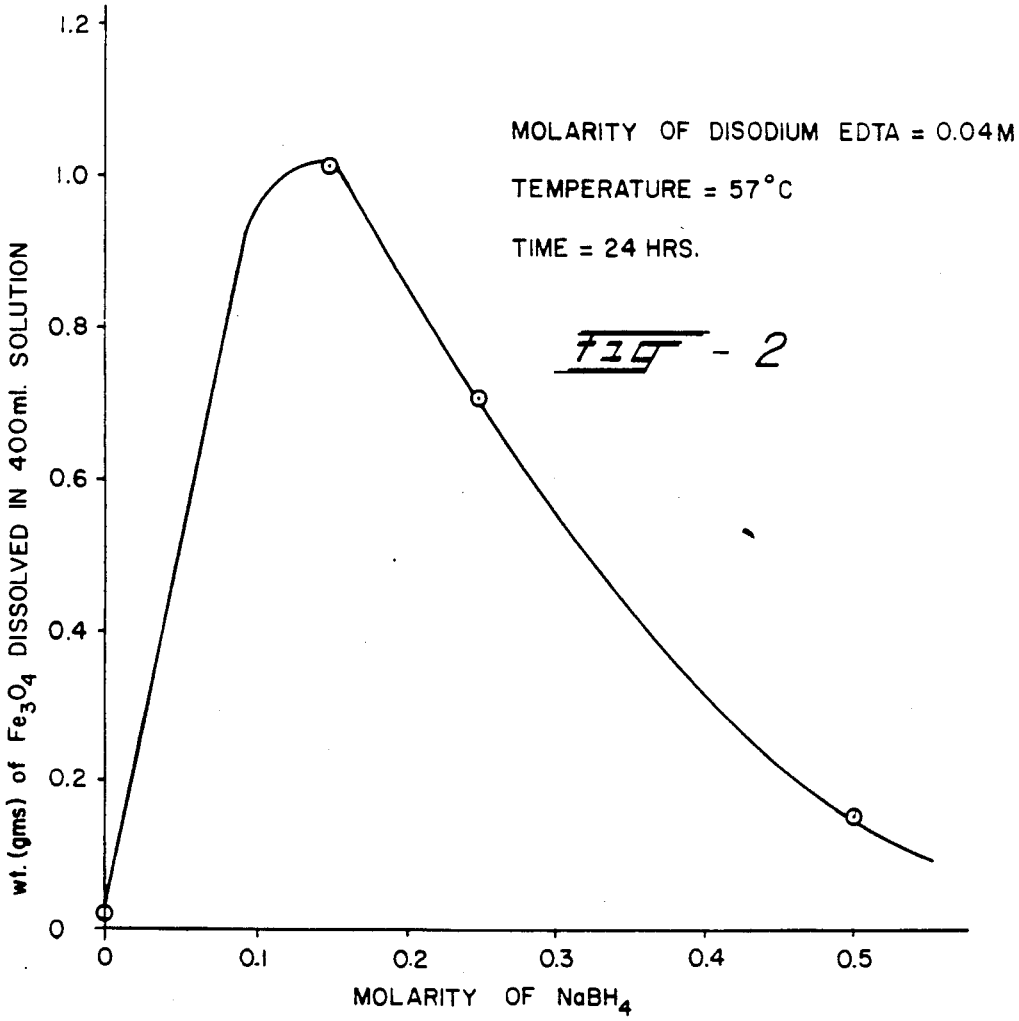
FIG. 2 is a graph illustrating the results obtained when the concentration of sodium borohydride is varied and the concentration of disodium salt of ethylenediaminetetraacetic acid is held constant.

The process of the invention is achieved by applying a special combination of reactants in a liquid medium to a corroded metal surface. Although water is a preferred medium other liquids, such as alcohols, ketones, hydrocarbons, and mixtures thereof can be used as long as the desired reactants are soluble or partially soluble therein. While the reaction is preferably conducted at elevated temperatures and pressures, as noted hereinafter, conditions should be employed to insure that the reaction medium is maintained in liquid form.

The alkali metal borohydride used in the process may be exemplified by sodium borohydride, potassium borohydride, lithium borohydride and the like, and mixtures thereof. Sodium borohydride is particularly preferred. The amount of the borohydride to be employed in the process may vary over a wide range depending upon the type of oxide to be dissolved, the amount and type of chelating agent employed, speed of reaction desired, etc. In general, the amount of the borohydride employed may vary from about 0.01 mol to 1.0 mol per liter of treating solution. Particularly preferred concentrations of the alkali metal borohydride to be employed are illustrated in the working examples at the end of the specification.

The chelating agent to be used in the process of the invention may be any chelating agent that forms a complex with the metal's oxide, preferably under neutral to alkaline pH conditions. Examples of such chelating agents include the salts, and preferably alkali metal salts, of organic acids. Such acids may be monocarboxylic or polycaboxylic and may be saturated or unsaturated, cyclic, heterocyclic or open-chained and monomeric or polymeric. Preferred acids are those which have, in addition to the caboxyl groups, additional groups which can coordinate with the metal atom through their electron pair, such as oxygen, nitrogen, hydroxyl, amino and the like. The donor groups should be separated from each other by chains of suitable length to allow the formation of five- or six-membered rings in the chelate structure.

Examples of such acids include the amino acids produced from proteins by hydrolysis, such as glycine, alanine, valine, leucine, isoleucine, phenylalamine, tryrosine, tryptophane, serine, thilanine, aspartic acid, glutaconic acid, lysine, arginine, histidine, cystine, methionine, proline, and hydroxyproline. Examples of other suitable acids include ethylenediamine tetraacetic acid (EDTA), nitrilsotriacetic acid (NTA) and diethylenetriamine pentacetic acid (DPTA), hydroxy-substituted acids, such as glyconic acid, and the like.

Preferred acids include the alpha and beta amino acids and especially the alpha and beta amino polycarboxylic acids containing up to 50 carbon atoms. Coming under special consideration are the alkylenepolyamine polyalkanoic acids and the polyalkylenepolyamine polyalkanoic acids, such as for example, ethylenediamine tetraacetic acid, diethylenetriamine pentaacetic acid and triethylenetetramine pentaacetic acid. Of special interest are the dialkali metal salts of ethylenediamine tetraacetic acid having the formula:

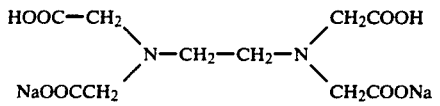

While the sodium salts of the above-described organic acids are preferred as chelating agents, other salts, and preferably the ammonium and alkali metal and alkaline earth metal salts, can also be employed.

The amount of the chelating agent to be employed in the process may vary over a wide range depending upon the type of oxide to be dissolved, the amount and type of borohydride employed, speed of reaction desired, temperature, agitation of solution, pH employed, etc. In general, the amount of the chelating agent to be employed may vary from 0.01 mol to 0.6 mol per liter of treating solution, and more preferably from about 0.02 mol to 0.3 mol per liter of treating solution. Particularly preferred concentrations of the chelating agent to be employed are illustrated in the working examples at the end of the specification.

The treating solution preferably has a pH which is neutral or in the alkaline range, and still more preferably from 7 to 13. Coming under special consideration is a pH range of 7 to 11. The pH can be controlled by the addition of conventional agents such as sodium hydroxide and other alkaline solutions.

Generally where the magnetite concentrations exceed 50% of the deposits total concentration, it is preferable to mix the solid borohydride to the deposits at a temperature of 60° C. or higher and then subsequently add the chelating or complexing agent at a pH of about 10–11. Where the magnetite concentration approaches 100%, temperatures in excess of 100° C. and pressures above one atmosphere are preferred.

The temperature used in the process of the invention may vary over a wide range, depending chiefly on the conditions of operation, the concentrations, and the need to maintain the solution in liquid form. Under normal operating conditions in the laboratory, temperatures may range from above freezing up to the boiling temperature of the liquid medium. In general, such temperature preferably ranges from about 10° C. up to 100° C. under atmospheric pressure. Temperatures greater than 100° C. can be used with pressure, particularly where the concentrations of magnetite exceed 90% of the total deposits. When operating on deposits found in nuclear reactors, it is normally required to employ pressures of around 800 psig.

The contacting of the metal oxide deposits with the above-noted solution can be accomplished by any suitable means, such as spraying, flooding, stirring, etc., as long as the proper contact of the solution with the metal oxide deposits is accomplished. In the case of treatment of deposits entrapped in the tube-to-tube sheet crevices of a nuclear steam generator, it is preferred to flood the area with the reaction solution and allow the solution to remain in contact with the deposits for a set period. The solution containing the dissolved metal oxides or decomposition products thereof is then pumped out.

The reaction time may vary depending upon the deposits, concentration of reactants, and the like. The time may vary, for example, from about a portion of an hour, such as thirty minutes, up to several weeks. In general, reaction times vary from about 1.0 hours to about 25 hours under laboratory conditions.

While the process of the invention has been described with particular reference to its use in dissolving, removing, or breaking up deposits of magnetite ($Fe_3O_4$), it can also be used to dissolve deposits of other iron oxides, such as hematite ($Fe_2O_3$) and wustite (FeO), as well as deposits of other metal oxides and salts as may be accumulated in difficult areas such as the tube-to-tube crevices of the nuclear steam generator. However, the removal of magnetite, the primary product of corrosion found in nuclear reactors, is the major product of corrosion to be removed.

Furthermore, while the process of the invention has been described with particular reference to the dissolving of deposits found in the nuclear steam generators, the process is equally effective in dissolving deposits of metal oxides found in other locations and surfaces. The process, for example, is effective for removing deposits in radiators, boilers, engines, and the like.

To illustrate the process of the invention, the following examples are given. It is to be understood, however, that the examples are given in the way of illustration and are not to be regarded as limiting the invention in any way.

EXAMPLE I (A) This portion of the example illustrates the unexpectedly superior results obtained by contacting solid crystals of $Fe_3O_4$ with an aqueous solution containing both sodium borohydride and disodium salt of ethylenediamine tetraacetic acid.

2.0791 grams of $Fe_3O_4$ crystals were added to 400 cc of water. To this was added 15.11 grams of sodium borohydride (1 mol solution) and 6.007 grams (0.04 mol) of disodium ethylenediamine tetraacetic acid. The pH of the solution was 11.5. The mixture was stirred and kept at about 60° C. for about 24 hours. The color of the mixture turned to a deep red. At the end of the reaction period, the $Fe_3O_4$ crystals were recovered, dried, and weighed to determine the loss of iron. The results indicate that 0.4217 grams of magnetite had been dissolved by the above treatment.

(B) This portion of the example illustrates the negative results obtained by contacting the solid $Fe_3O_4$ crystals with an aqueous solution containing only the sodium borohydride.

0.5031 grams of $Fe_3O_4$ crystals were added to 300 cc of water, and to this solution was added 11.34 grams (1 mol) of sodium borohydride. The pH of the solution was about 12.5. The mixture was stirred and maintained at 63° C. for approximately 24 hours. There was little change in the color of the solution. At the end of that period, the crystals of $Fe_3O_4$ were recovered, dried and weighed. There was no significant change in the weight of the iron oxide indicating that the solution was not effective in dissolving the $Fe_3O_4$. X-ray analysis also indicated no sub-oxides or iron metal present.

(C) This portion of the example illustrates the negative results obtained by treating the $Fe_3O_4$ crystals with an aqueous solution containing only the disodium salt of ethylenediamine tetraacetic acid.

1.009 grams of $Fe_3O_4$ crystals were added to 300 cc of water and to this mixture was added 24.01 grams (0.22 mols) of disodium salt of ethylenediamine tetraacetic acid and 50 grams of steel particles. Sodium hydroxide was added to bring the pH to about 9. The mixture was stirred and kept at about 67° C. for 24 hours. At the end of that time, the results indicate that there had been some change in the weight of the iron oxide but there was also a serious loss of weight of the steel. Therefore, the solution could not be used to dissolve the iron oxide deposits when in contact with steel.

EXAMPLE II

This example illustrates that while the solutions used in the process of the invention dissolve the $Fe_3O_4$, they have little effect on the steel and inconel tubing which might be present during the reaction.

0.4798 grams of $Fe_3O_4$ crystals were added to 400 cc of water and to this mixture was added 7.8656 gram (0.52 mol) of sodium borohydride and 6.0293 grams (0.04 mol) of disodium salt of ethylenediamine tetraacetic acid. 51.7611 grams of inconel and 50.2580 grams of mild steel were placed in the above solution, and the mixture was maintained at 55° C. for approximately 67 hours. At the completion of the test, the inconel was recovered, dried, and weighed. The inconel showed no loss in weight. The final weight of mild steel was 50.2446 grams, indicating that there had been no significant loss of steel due to the above treatment.

EXAMPLE III

This example illustrates the preferred proportions of reactants to be used in the process of the invention.

A series of four solutions was prepared by adding 2.004 grams of $Fe_3O_4$ crystals to 400 cc of water and 3.79 grams (0.25 mol) of sodium borohydride. The pH of each solution was about 11.5.

Varying amounts of the disodium ethylenediamine tetraacetic acid were added to these solutions as indicated below:

| | |
|---|---|
| Solution One: | 1.4910 grams (0.01 mol) |
| Solution Two: | 6.007 grams (0.04 mol) |
| Solution Three: | 29.76 grams (0.2 mol) |
| Solution Four: | 14.88 grams (0.1 mol) |

These solutions were stirred and kept at about 57° C. for about 24 hours. At the end of that time, the iron oxide was recovered, dried, and weighed. The loss of weight of iron for each solution is shown in the graph in FIG. 1. The graph shows that using a 0.25 mol solution of the borohydride, the most effective amount of the disodium salt of ethylenediamine tetraacetic acid to be used is the 0.04 mol solution.

EXAMPLE IV

This example illustrates the preferred proportions of reactants to be used in the process of the invention.

A series of three solutions was prepared by adding 2.079 grams of $Fe_3O_4$ crystals to 400 cc of water and 6.02 grams of disodium salt of ethylenediamine tetraacetic acid (0.04 mol). The pH of the solutions was about 12.5.

Varying amounts of sodium borohydride were added to these solutions as indicated below:

| | |
|---|---|
| Solution One: | 7.57 grams (0.5 mol) |
| Solution Two: | 3.78 grams (0.25 mol) |
| Solution Three: | 2.28 grams (0.15 mol) |

These solutions were stirred and kept at 57° C. for 24 hours. At the end of that time, the iron oxide was recovered, dried, and weighed. The loss of iron for each solution is shown in the graph of FIG. II. The graph illustrates that with the 0.04 mol solution of disodium ethylenediamine tetraacetic acid, the preferred amount of sodium borohydride is a 0.15 mol solution.

We claim:

1. A process for dissolving deposits of magnetite from a metal surface comprising contacting said metal surface with an aqueous solution maintained at a pH from neutral to alkaline and containing from 0.01 to 0.8 mol of an alkali metal borohydride and from 0.01 to 0.6 mol of an iron chelating agent per liter of said solution.

2. The process of claim 1 wherein said chelating agent is a dialkali metal salt of polyalkylene polyamine tetraacetic acid.

3. The process of claim 2 wherein said alkali metal borohydride is sodium borohydride.

4. The process of claim 3 wherein said aqueous solution is maintained at a temperature of between 10° C. and 100° C.

5. The process of claim 3 wherein said aqueous solution is maintained at a temperature of greater than 100° C. at a pressure greater than ambient.

6. A composition comprising an aqueous solution at a pH from neutral to alkaline and containing from 0.01 to 0.6 mol of a dialkali metal salt of ethylenediamine tetraacetic acid and from 0.01 mol to 0.8 mol of an alkali metal borohydride per liter of said solution.

7. A process for removing deposits of magnetite on tube-to-tube sheet crevices of a nuclear steam generator which comprises contacting said deposits with an aqueous solution containing from 0.01 to 0.8 mol of an alkali metal borohydride per liter of said solution at a temperature higher that 50° C., adding subsequently to said solution from 0.01 mol to 0.6 mol of an iron chelating agent per liter of said solution, maintaining said solution in contact with said deposits for a period of time sufficient to dissolve a substantial portion of said deposits of magnetite with said solution and removing said aqueous solution and said dissolved magnetite from said generator, said solution being maintained at a pH of greater than 7.

8. The process of claim 7 wherein the temperature of said solution is maintained at a temperature of 100° C. or higher while in contact with said deposits for a period of at least thirty minutes.

9. The composition of claim 6 wherein the dialkali metal salt of ethylenediamine tetraacetic acid is a disodium salt of ethylenediamine tetraacetic acid.

* * * * *